US009605401B2

(12) United States Patent
Ivars Salom et al.

(10) Patent No.: US 9,605,401 B2
(45) Date of Patent: Mar. 28, 2017

(54) GRAVITY-BASED FOUNDATION SYSTEM FOR THE INSTALLATION OF OFFSHORE WIND TURBINES AND METHOD FOR THE INSTALLATION OF AN OFFSHORE WIND TURBINE FOUNDATION SYSTEM

(71) Applicant: Tecnica Y Proyectos, S.A., Paterna (Valencia) (ES)

(72) Inventors: Javier Ivars Salom, Paterna (ES); Rafael Molina Sanchez, Paterna (ES); Jose Maria Garcia-Valdecasas Bernal, Paterna (ES); Miguel Angel Cabrerizo Morales, Paterna (ES)

(73) Assignee: Tecnica y Proyectos, S.A., Paterna (Valencia) (ES)

( * ) Notice: Subject to any disclaimer, the term of this patent is extended or adjusted under 35 U.S.C. 154(b) by 0 days.

(21) Appl. No.: 14/427,230

(22) PCT Filed: May 28, 2013

(86) PCT No.: PCT/ES2013/070339
§ 371 (c)(1),
(2) Date: Mar. 10, 2015

(87) PCT Pub. No.: WO2014/053680
PCT Pub. Date: Apr. 10, 2014

(65) Prior Publication Data

US 2015/0240442 A1 Aug. 27, 2015

(30) Foreign Application Priority Data

Oct. 3, 2012 (ES) ..... 201200994

(51) Int. Cl.
*E02D 27/42* (2006.01)
*E02D 23/02* (2006.01)
(Continued)

(52) U.S. Cl.
CPC ..... *E02D 27/425* (2013.01); *E02D 23/02* (2013.01); *E02D 27/10* (2013.01); *E02D 27/22* (2013.01);
(Continued)

(58) Field of Classification Search
CPC ..... E02D 27/425; E02D 27/06; E02D 23/02
See application file for complete search history.

(56) References Cited

U.S. PATENT DOCUMENTS 3,653,219 A * 4/1972 Mott ..... E02B 17/027 175/7
4,045,968 A * 9/1977 Gerwick, Jr. ..... E02B 17/025 248/357
(Continued)

FOREIGN PATENT DOCUMENTS

DE 202011101599 U1 * 9/2011 ..... E02B 17/0004
EP 1707808 A2 10/2006
WO 9951821 A1 10/1999

*Primary Examiner* — Tara M. Pinnock
(74) *Attorney, Agent, or Firm* — Hayes Soloway PC

(57) ABSTRACT

The present invention relates to a gravity-based foundation system for offshore wind turbine installation that comprises three floating concrete bases built with self-floating concrete caissons, equipped with valves for filling them with water and emptying the water out enabling their ballasting and anchoring at their final location; a metal structure which connects the floating concrete bases by means of a connecting element to the wind turbine tower, and a metal element which connects the floating concrete bases to the wind turbine, metal element on which a docking area is installed, a maintenance platform and access stairs, and it also relates to a method of installation of the gravity-based foundation system.

18 Claims, 9 Drawing Sheets

(51) Int. Cl.

| | |
|---|---|
| ***E02D 27/52*** | (2006.01) |
| ***E02D 27/10*** | (2006.01) |
| ***E02D 27/22*** | (2006.01) |
| ***E02D 27/50*** | (2006.01) |
| *E02B 17/00* | (2006.01) |

(52) U.S. Cl.
CPC ..... *E02D 27/50* (2013.01); *E02D 27/52* (2013.01); *E02B 2017/0065* (2013.01); *E02B 2017/0069* (2013.01); *E02B 2017/0091* (2013.01)

(56) References Cited

U.S. PATENT DOCUMENTS 4,553,878 A * 11/1985 Willemse ..... E02B 17/02 405/203
4,733,993 A * 3/1988 Andreasson ..... B63B 21/26 114/296
4,821,804 A * 4/1989 Pierce ..... E02B 17/00 166/367

* cited by examiner

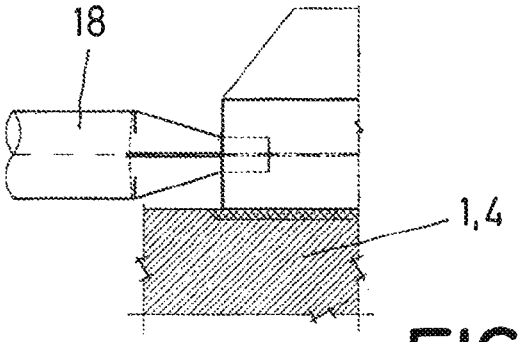
B-B
FIG.10
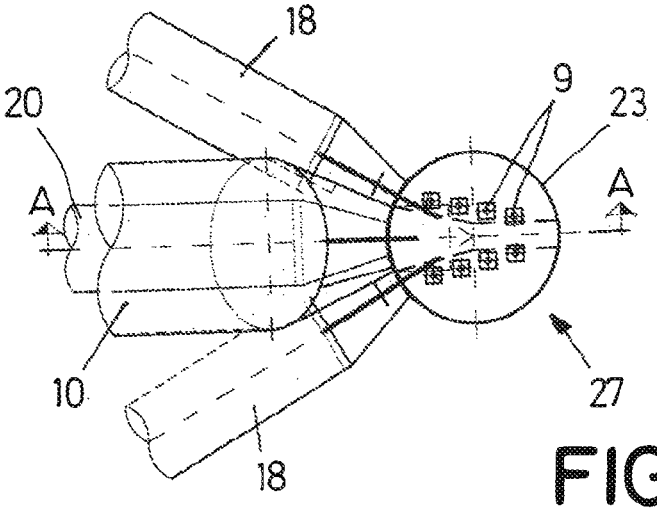
FIG.11
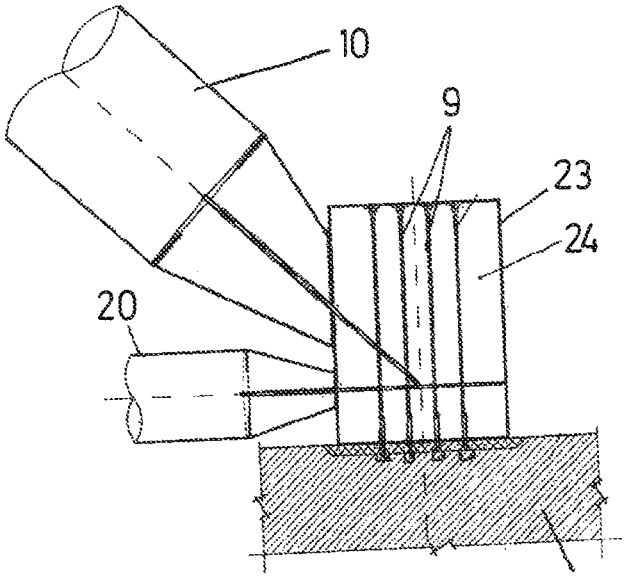
FIG.12 A-A

GRAVITY-BASED FOUNDATION SYSTEM FOR THE INSTALLATION OF OFFSHORE WIND TURBINES AND METHOD FOR THE INSTALLATION OF AN OFFSHORE WIND TURBINE FOUNDATION SYSTEM

OBJECT OF THE INVENTION

The present invention can be included in the technical field of gravity-based foundation systems for the installation of offshore wind turbines.

The object of the invention is a gravity-based foundation system for the installation of offshore wind turbines which enables the transporting, anchoring and subsequent refloating of the wind turbine structure assembly once anchored, giving great versatility to the solution with regard to the uncertainties associated with the installation and how the terrain responds in the short and long term, as well as the method for installing the preceding gravity-based foundation system.

BACKGROUND OF THE INVENTION

One of the main problems of the offshore wind sector is the support structure that serves as the base of the wind turbine. This sector has addressed the development of fixed and floating wind turbines depending on the depth at which the wind turbine is to be installed. The technical and economic feasibility of offshore wind systems requires the optimization and development of these support structures.

Depending on the manner in which the structure is supported on the seabed there are two generic types of fixed structures, namely, those resting on the seabed, which are called gravity-based structures, and those buried in the ground. Gravity-based foundations are the solution used when the seabed is not suitable for drilling, using the own weight of the foundation and of its possible ballasting to maintain the turbine stable and upright. In general, the solutions that have been developed for gravity-based foundations can be classified both conceptually and constructively in the following manner:

- Conical frustum-shaped gravity-based foundation, with varying slenderness and inclination of the conical section.
- Foundation composed of a broad base on which a slender shaft is built. It is a similar solution to that used in bridge piers.

These solutions may include steel flaps at the base to confine the terrain to facilitate the piling using suction chambers and/or to develop localized terrain improvements, depending on the characteristics thereof.

Selection of offshore wind turbine foundations, both for piling and gravity-based solutions, is conditioned by two dominant factors: the geomorphologic nature of the seabed and the depth of the potential site.

As the depth of 40-50 meters is approached, offshore wind turbine installation encounters economic and technical difficulties that limit the development of this sector and its profitability. The dimensions of the foundations, construction and on-site installation difficulties, the loads transmitted to the terrain and the potential loss of verticality of the assembly restrict the available sites where it is feasible to develop these solutions in the coastal shelf.

In addition to the difficulties addressed, installing some of the solutions developed to date require the use of specialized maritime means, specifically designed for transport and on-site installation. Currently the number of ships available with these features is very limited and the cost of freight or its implementation is very high.

Systems known in the prior art include the international application WO2011147592 on an offshore platform foundation structure used for tripod or metal jackets consisting of one or more solid elements with a flap on which the foundation legs are supported.

The preceding structure requires expensive maritime means presenting large lifting capacity to accomplish placement; furthermore, this structure is not self-floating and it is not possible to transport the wind turbine on the said structure from land to the installation location.

Furthermore, according to this solution, the metal structure formed by the tripod or jackets reaches the seabed, which increases the use of metal and consequently the cost of such a solution, besides it having a limited stability in the event of horizontal movement.

Also known is the European patent application EP2539219 relating to a device and method for transporting and installing a gravity-based foundation offshore wind turbine. Said solution is not self-floating, it is expensive and requires marine means with high lifting capacity for its placing, thus not allowing the transport of the wind turbine on its structure from land, therefore requiring the incorporation of additional weight to the structure to increase its stability once anchored, by means of aggregate or concrete blocks; accordingly, it is not compatible with low-bearing capacity terrain and offers limited stability against overturning.

DESCRIPTION OF THE INVENTION

The solution proposed by the present invention is based on the use of three hollow reinforced concrete bases incorporating a valve system whereby water is filled into and emptied out of its interior acting as ballast. A metal structure connects these three concrete bases with a shaft or connecting element, which starts at the centre of the structure and emerges over the water surface, and to which the element connecting the wind turbine tower will be connected and on which the docking area, stairs and maintenance platform will be installed.

After transporting the structure to its installation site, the concrete bases fill with water for ballasting and anchoring by means of traditional systems. The ballast system design allows the refloating of the structure once anchored, which gives the solution great versatility with regard to the uncertainties associated with on-site installation and terrain response in the short and long term.

The three legs provide greater stability compared to mono-block gravity-based foundations. In addition to its enhanced behaviour in less competent terrain, it provides a better load distribution and transmits less stress to the terrain. The metal structure enables the reduction of the section of the structure, minimizing the contact surface with the waves and therefore the stresses transmitted by the flow-structure interaction and reducing the total weight of the foundation, lowering the centre of gravity thereof and thus improving its navigability.

The proposed foundation based on the three self-floating concrete bases is entirely modular so it is feasible to manufacture it in several production centres for subsequent assembly at the port.

The proposed solution is self-floating so it can be towed to its final location. The triangle configuration of the floats provides great naval stability. In addition, this structure allows for the assembly of the wind turbine at the port, thus speeding up the pace of assembly since smaller operating windows are needed.

Conventional tugs are used for its transport. Since no specific ships are needed, it is much easier to have several units allowing the simultaneous transport and installation of several systems, reducing installation costs and times.

Connecting the metal structure to the three concrete bases is performed by three mixed connecting nodes each of which comprises a concrete core and prestressed system integrated therein.

This mixed connecting node responds optimally to the construction needs, since it can be used as a purely prefabricated system, with an arrangement capable of handling the execution and assembly tolerances required; otherwise, as a partly prefabricated system, combining the factory manufacturing of the metal structure with the concreting of all or part of the node at the port.

The metal structure which joins the three concrete bases to the connecting element comprises three inclined diagonal rods whose ends which connect to each mixed connecting node are conical frustum-shaped which enables the appropriate adjustment of the mechanical constraints.

In this regard, the solution of the mixed connecting node with a concrete core and prestressing system integrated therein makes the following possible:

- Ensuring that the axial actions of the rods converging on the mixed connecting node converge on a given point, minimizing actions due to the eccentricities of the components making up the metal structure-mixed connecting node-floating concrete base assembly.
- Minimizing the physical dimensions of the mixed connecting node which, receiving the ends of the rods converging therein, envelops the convergence point.
- Minimizing bending stresses by embedding the rods in the mixed connecting node.
- Conducting a dominant use of the prestressing system to achieve the required capacity of transfer of force in the mixed connecting node to the floating concrete base.

Each of the three floating concrete bases comprises a lower slab which is in contact with the ground once the system is submerged, an upper slab and a perimeter wall. These elements are reinforced with concrete interior walls, which in turn define groups of interconnected cells.

The floating concrete bases are executed by continuous sliding on a floating platform and comprise a control system to carry out the ballasting by means of a valve assembly arranged on said floating concrete bases to allow the filling of a first group of cells which are filled with water and injecting compressed air for emptying them.

The floating concrete bases may optionally have a second group of cells not involved in flotation in order to access from the upper slab the contact surface between the lower slab and the terrain, and thus improve the terrain bearing capacity or the level of embedment therein.

Floating concrete bases perform the following functions:

- Serving as a foundation to the metal structure to which the connecting element of the wind turbine is attached during the transport, anchoring and service stage.
- Increasing naval stability during the transport and anchoring stages both to allow navigation in more energetic climatic conditions compared to those tolerated by single-volume solutions, and to improve safety in the anchoring or submerging stage of the structure as a whole.
- Providing the system with towing points for the purpose of its towing during transport stage with the possibility of installing floats.
- Increasing stability to prevent overturning and sliding, placing the masses away from the roll-over and rotation centre, which favours increased inertia of the structure assembly, displacing the mass centre near the bottom.
- Minimizing static and dynamic loads transmitted to the terrain by increasing the distribution of burden of own weight per unit of surface area and by enhancing the existence of restoring forces.
- Allowing the load transmitted by each caisson to be different from that of the others during the service stage by means of differential ballasting level.
- Limiting global and differential sites in the short and long term.
- Keeping the metal structure supporting height at the same depth, wherein only the mainstay of the concrete floating base varies.
- Controlling the naval stability and buoyancy during the implementation, transport, anchoring and service stages.

The metal structure performs the following functions:

- Serving as a transition element between the floating concrete bases and the wind turbine connecting element, reaching a shelter height over the maximum level reached by the free surface of the sea.
- Preventing relative movement between the floating concrete bases.
- Limiting or reducing the interaction between the sea flow and the structure, which becomes greater as one approaches the surface.
- Limiting the transmission of high-frequency dynamic loads between floating concrete bases and the terrain.

The procedure for the installation of an offshore wind turbine foundation comprises the following stages:

- A first transport stage wherein the foundation system is towed from a collecting and/or assembly dock to the final location by using tug boats where the floating concrete bases are anchored.
- A second anchoring stage wherein the foundation system is anchored until making contact with the seabed modifying the overall buoyancy by the controlled ballasting of some groups of cells in the floating concrete foundations with the operation of valves located in said bases, and
- A third refloating stage in the event of dismantling or repositioning of the foundation system by evacuating the water ballast from the previously ballasted cell groups to achieve positive buoyancy of the foundation system.

Between the second and the third stage there is the service stage or stage in which the wind turbine is operated.

The gravity-based foundation system for offshore wind turbine installation further comprises a control system which in turn comprises a sensing subsystem, an operational control subsystem and a decision-making subsystem during the transportation, anchoring, service and refloating stages, wherein the operational control subsystem enables the coordination between the sensing subsystems and the decision-making support subsystem.

One of the possible foundation manufacturing methods, taking into account the development of civil engineering construction techniques is as follows: Being a mixed structure of concrete and steel, the manufacturing processes for the concrete bases and the metal structure are independent. Concrete bases are manufactured at the dock of a port using a floating dock, called floating caisson, fitted with a sliding formwork system similar to that used in the construction of concrete caissons for port docks. This process enables the construction of a concrete base with high internal void ratio that ensures adequate buoyancy thereof. During the manufacturing process a steel tubular projection is left embedded to serve as the connection between the metal structure and concrete bases. The metal structure is manufactured in stages on land; on the one hand the metal structure that connects to the concrete bases and on the other hand the shaft or connecting element which serves as the base of the wind turbine. The metal structure is made by welding the joints. After finishing the concrete bases, and being sheltered within the port, the bases are positioned and the metal structure is installed by using a crane. Once the metal structure is integral to the bases the metal shaft or connecting element in positioned and welded to the rest of the structure. At this time, the element is ready for pre-anchoring in a protected area before its final transport and installation in the offshore wind park. The transport process is performed by means of tugs, which will place the element in its final position and the latter will be anchored using anchors and winches, which will fix the position of the structure. By means of a valve system installed in the concrete base, it will fill up with water, allowing its controlled anchoring until its positioning on the seabed.

The industrial application of the present invention is based on the fact that the offshore wind energy industry is one of the sectors for which most development is predicted in the coming years. Currently, most of the major electricity developers and technologists are studying the best alternatives for the installation of offshore wind turbines.

The proposed solution solves the foundation for the installation of the turbines in most of the sites addressed, enabling the installation of thousands of wind turbines. Technologists and ancillary industry will adapt their processes to the manufacture and supply of these foundations.

The metal structure is composed of tubes whose size is smaller than that of the wind turbine shafts themselves (6-3 meters), with potential synergies with the wind industry itself.

This solution is completely modular and thus supports manufacturing strategies in different centres for subsequent assembly at the port. This will minimize potential problems in the supply of materials. The caissons themselves are of a size such that they could also be manufactured in different centres and thereafter be transported to the assembly port.

DESCRIPTION OF THE DRAWINGS

To complete the description being made and for a better understanding of the characteristics of the invention, according to a preferred practical embodiment thereof, a set of drawings is attached as an integral part of the description, which by way of example without limiting the scope of this invention, show the following:

FIG. 10.—Shows a sectional view BB of FIG. 8.

FIG. 11.—Shows a plan view of the detail of the metal structure rod connection to the mixed connecting node according to a second embodiment thereof.

FIG. 12.—Shows a sectional view AA of FIG. 11.

PREFERRED EMBODIMENT OF THE INVENTION

Figure 1:
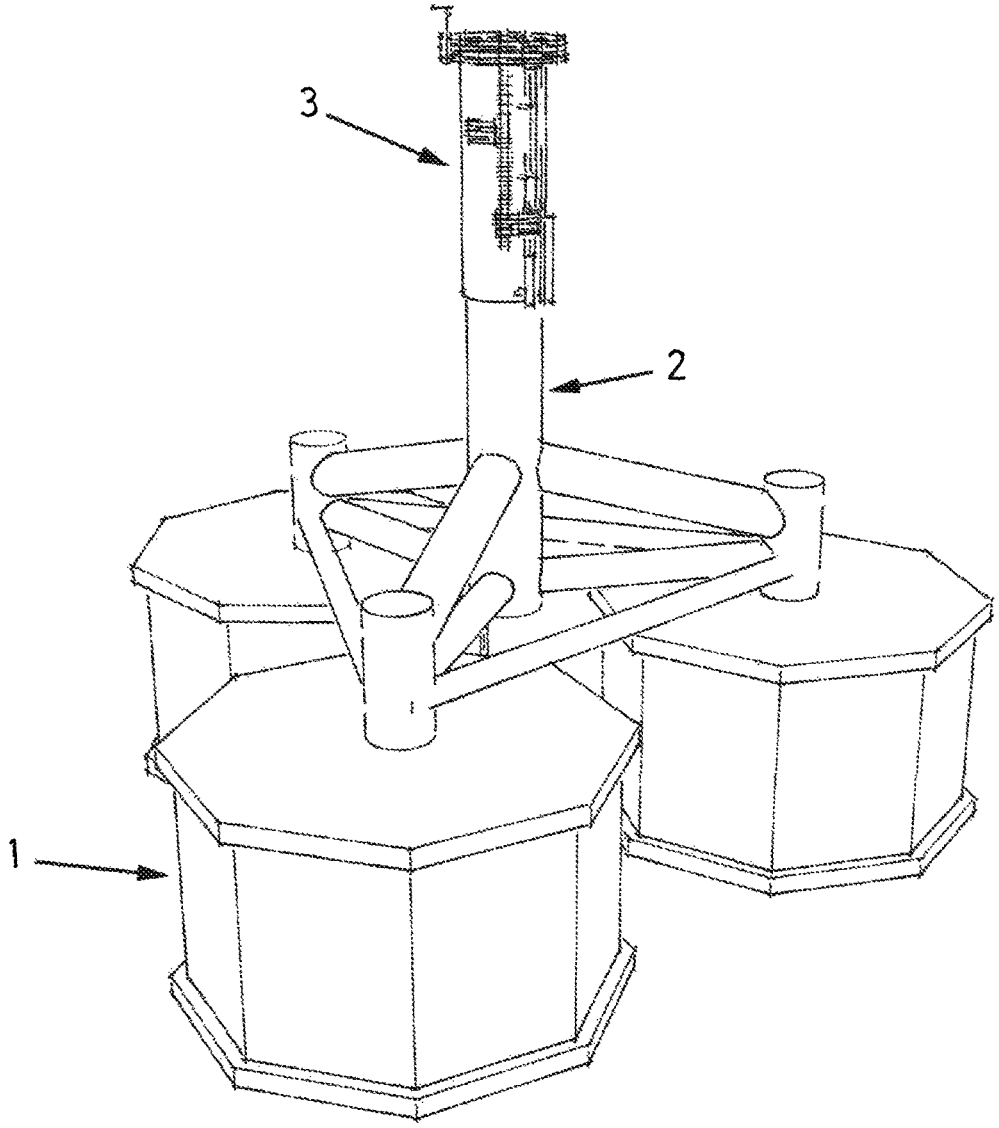
FIG. 1—Shows a perspective view of a first embodiment of the gravity-based foundation system for offshore wind turbine installation of the present invention.
Figure 2:
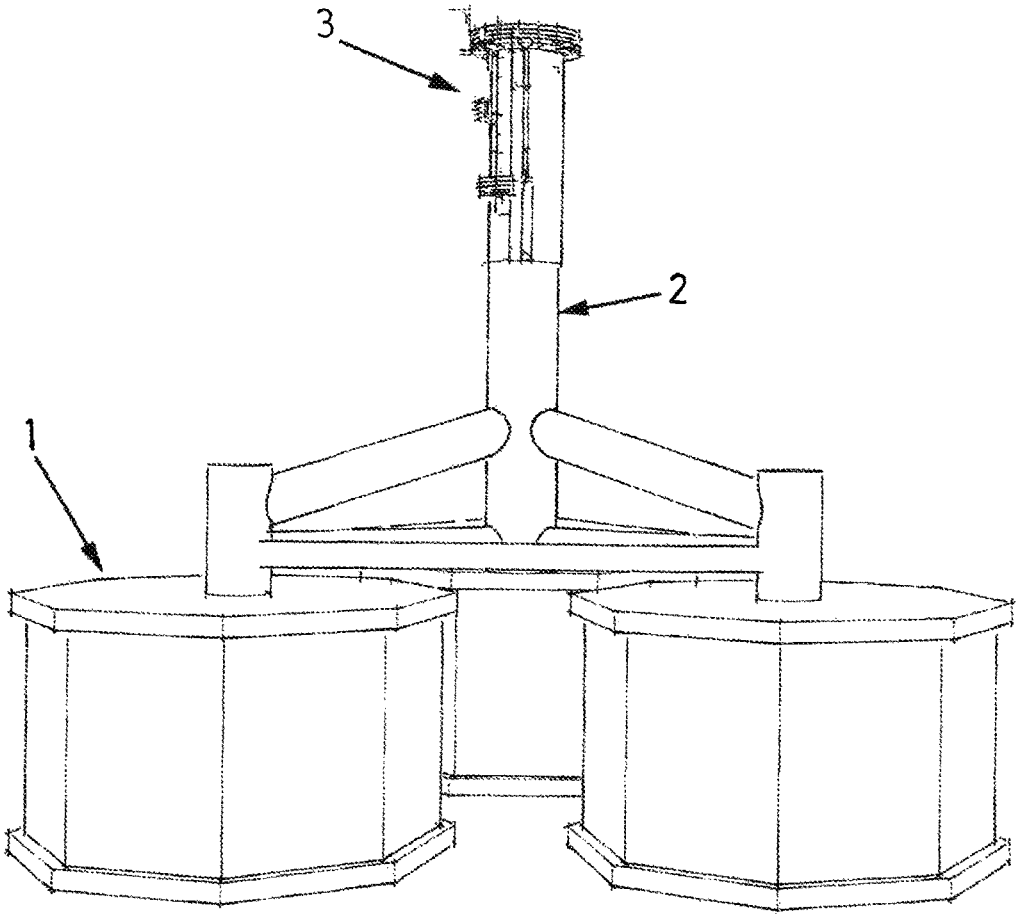
FIG. 2.—Shows an elevation view of FIG. 1.
Figure 3:
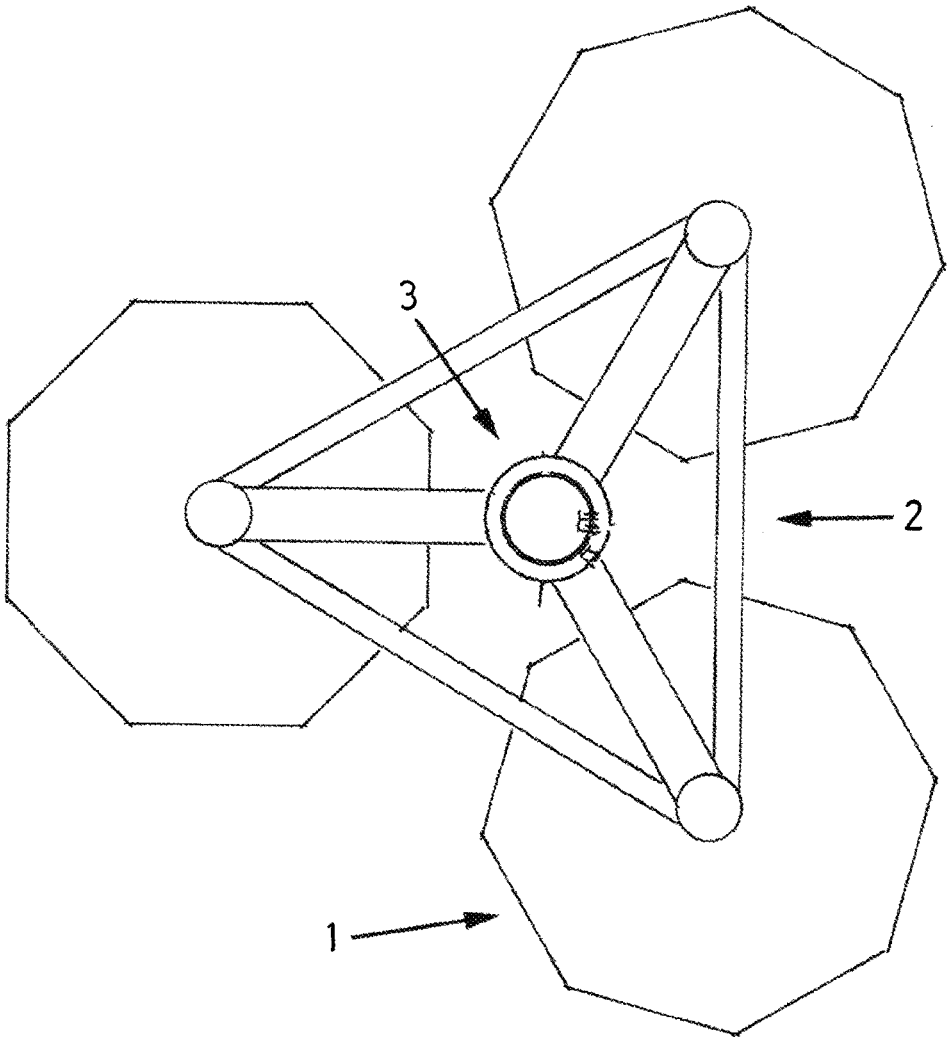
FIG. 3.—Shows a plan view of FIG. 1.

FIGS. 1 to 3 identify the main parts comprised by the gravity-based foundation system for offshore wind turbine installation according to a first embodiment. These figures identify the following elements:

- Floating concrete bases (1) or hollow concrete supports, known as "caissons" in the field of maritime civil engineering, with an integrated valve system to allow the ballasting and de-ballasting of the base with water.
- Tripod-shaped metal structure (2) attaching the concrete bases to a connecting element (3) to the height of the wind turbine installation.
- Connecting element (3) between the floating concrete bases (1, 4) and the wind turbine. It includes a maintenance ship docking system and the stairs for access to the base of the wind turbine, as well as the system for attaching the wind turbine to the foundation.

Figure 4:
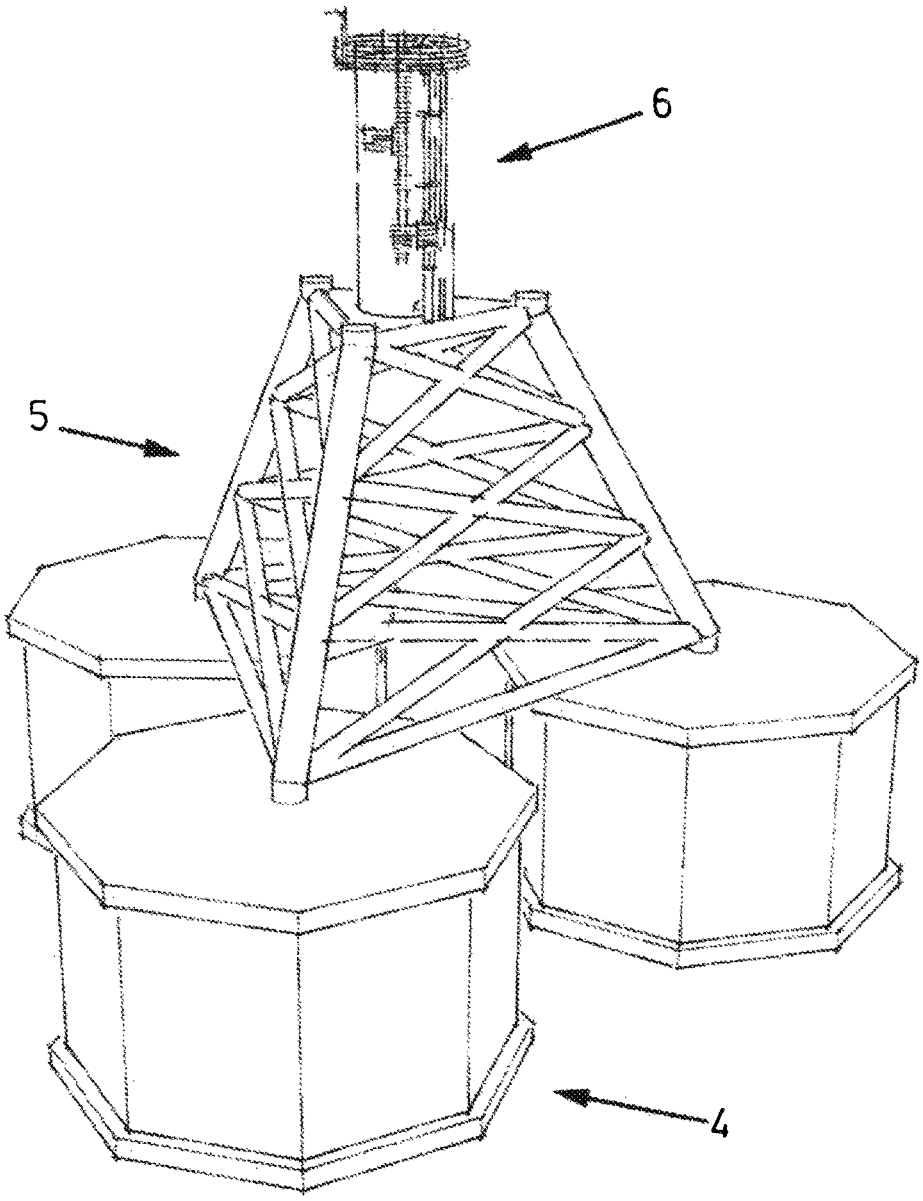
FIG. 4.—Shows a perspective view of a second embodiment of the gravity-based foundation system for offshore wind turbine installation of the present invention.
Figure 5:
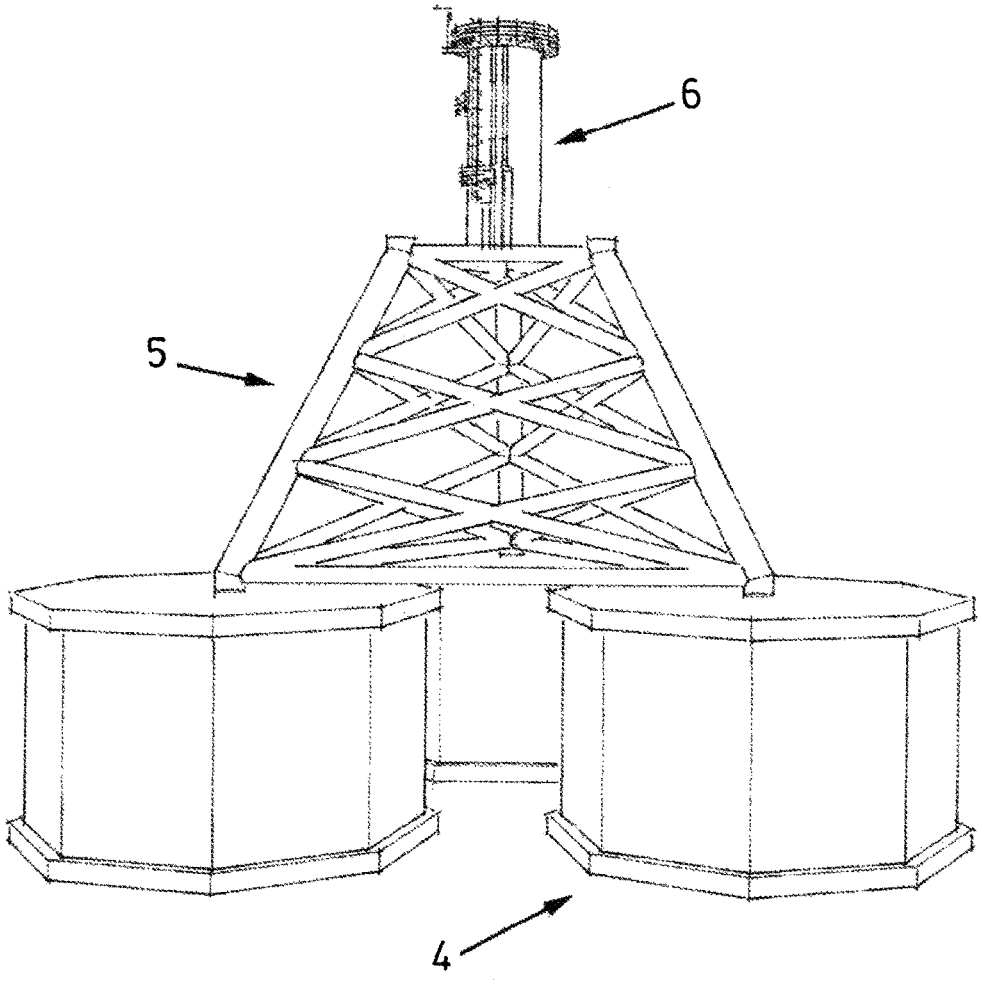
FIG. 5.—Shows an elevation view of FIG. 4.
Figure 6:
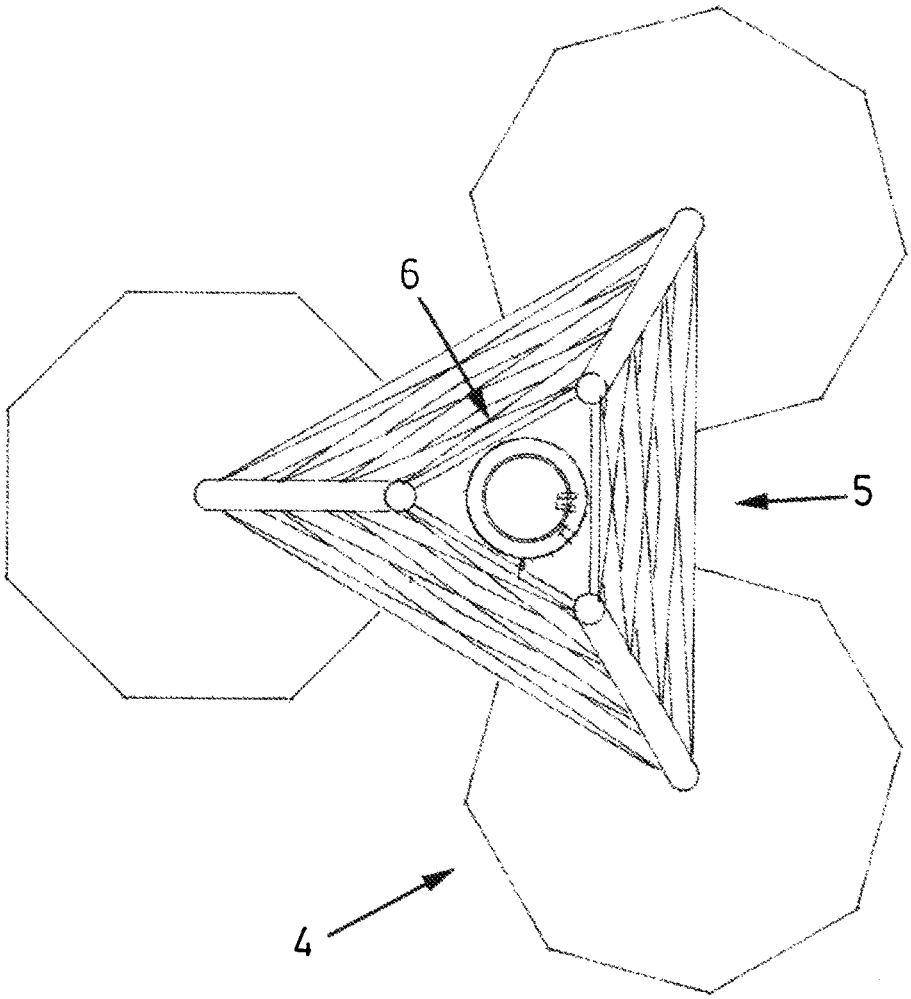
FIG. 6.—Shows a plan view of FIG. 4.
Figure 7:
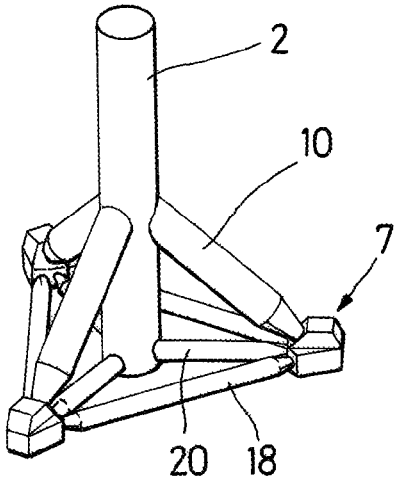
FIG. 7.—Shows a perspective view of a first embodiment of the mixed connecting node between the metal structure and each of the floating concrete bases.
Figure 8:
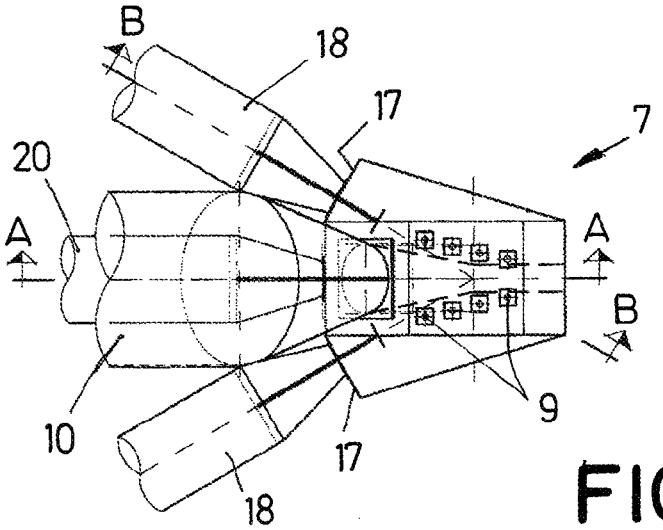
FIG. 8—shows a plan view of the detail of the metal structure rod connection to the mixed connecting node.
Figure 9:
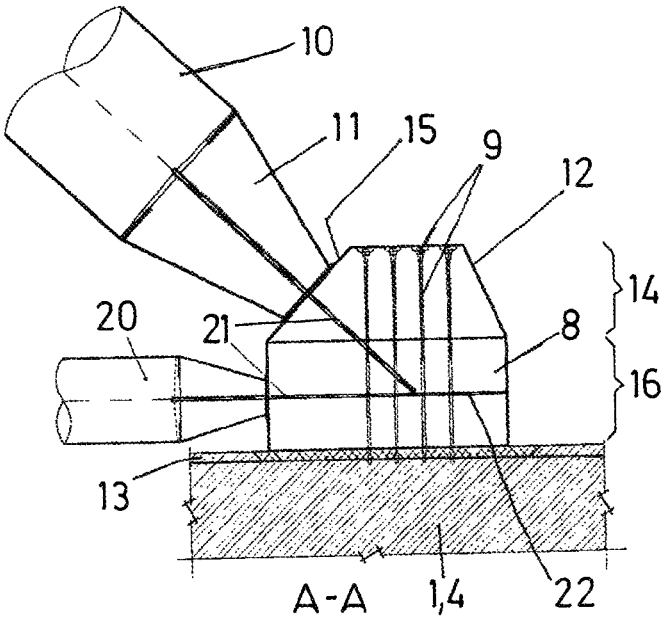
FIG. 9.—Shows a sectional view AA of FIG. 8.
Figure 13:
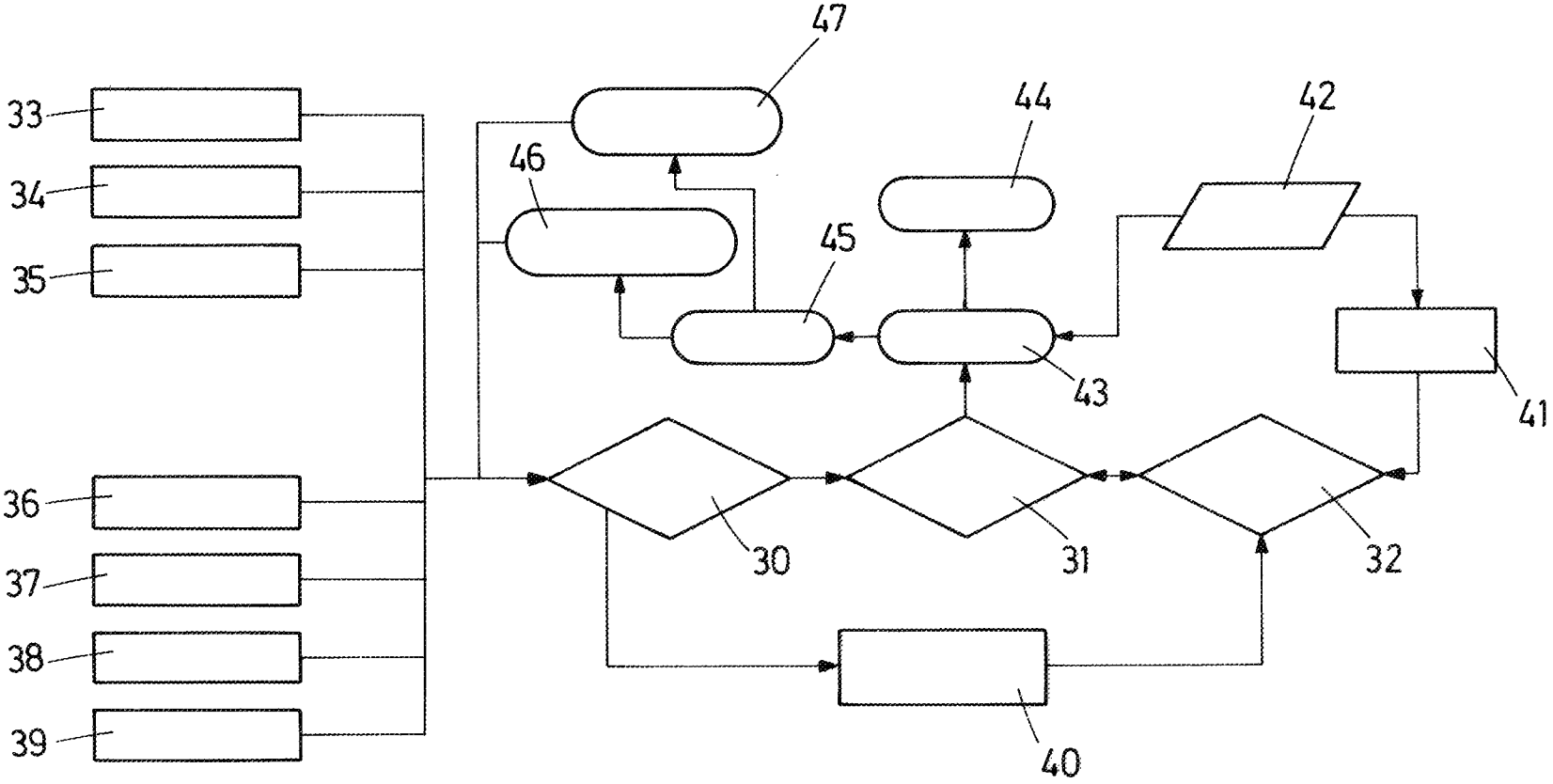
FIG. 13.—Shows a block diagram of the control system of the gravity-based foundation system for offshore wind turbine installation.

FIGS. 4 to 6 show the main parts are identified comprised by the gravity-based foundation system for offshore wind turbine installation according to a second embodiment. These figures identify the following elements:

- Hollow reinforced floating concrete bases (4), known as "caissons" in the field of maritime civil engineering, with an integrated valve system to allow the ballasting and de-ballasting of the base with water.
- Lattice-shaped metal structure (5) as to join the floating concrete bases (4).
- Connecting element (6) between the floating concrete bases (1, 4) and the wind turbine. It includes the maintenance ship docking system and the stairs for access to the base of the wind turbine, as well as the system for attaching the wind turbine to the foundation.

In either embodiment, the attachment of the metal structure (2, 5) to the three floating concrete bases (1, 4) is performed by means of mixed connecting nodes (7, 27), one for each floating concrete base (1, 4), each of which comprises a concrete core (8) and a prestressing system (9) integrated therein.

The metal structure (2, 5) attaching the three floating concrete bases (1, 4) to the connecting element (3, 6) comprises three inclined diagonal rods (10) whose ends (11) which connect to each mixed connecting node (7, 27) are conical frustum-shaped which enables the appropriate adjustment of the mechanical constraints.

The mixed connecting node (7, 27) further comprises a sheet metal coating (12) externally covering the concrete core (8), a metal coating (12) whose primary function is to assist in the transfer and resistance to the stresses caused by the forces introduced by the inclined diagonal rods (10) in the mixed connecting nodes (7, 27), although it also acts as a closure and protection element for the concrete core (8) used, to promote durability conditions thereof and, above all, of the working conditions of the prestressing system (9) situated in the mixed connecting node (7, 27) of the metal structure (2, 5) and the floating concrete base (1, 4).

The mixed connecting node (7, 27) further comprises anchors that are actively involved in the transmission of forces, while the floating concrete base (1, 4) comprises passive anchors disposed in its interior, either directly in an upper closing slab (13) or in rigidity partition walls or interior walls situated under the mixed connecting nodes (not shown).

On these anchors arranged on the upper closure slab (13) or on the rigidity walls the upper closure slab (13) of the floating concrete base (1, 4)—where partly prefabricated—is concreted, whereby only some sheaths with tendons inside (not shown) remain exempt, while in the case of prefabricated mixed connecting nodes (7, 27), the latter together with some sheaths, tendons and passive anchors will be placed in an approximate position during the concreting of the floating concrete base (1, 4).

In a first embodiment of the mixed connecting node (7) shown in FIGS. 7 to 10, the metal coating (12) of the mixed connecting node (7) has a polyhedral-like geometric shape with an upper prismatic-trapezoidal-shaped area (14) wherein one of the sides (15), the one that receives an inclined diagonal rod, is in turn inclined and perpendicular to the inclined diagonal rod, and a lower irregular prismatic-hexagonal-shaped area (16), wherein two of its vertical sides (17), which receive some first auxiliary rods (18) linking together two adjacent mixed connecting nodes (7) of each floating concrete base (1), are perpendicular to said first auxiliary rods (18), wherein the sides (15, 17) at which the inclined diagonal rod and the first auxiliary bars join are made of sheet steel.

Furthermore, at the mixed connecting node (7), a vertical side (19) of the lower irregular prismatic-hexagonal-shaped area (16) which is situated between the two vertical sides (17) that receive the first auxiliary rods (18), receives a second auxiliary rod (20) joining the mixed connecting node (7) to the connecting element (3).

Therefore, in this first embodiment of the mixed connecting node (7), said mixed connecting core (7) receives, via the metal coating (12) with a tubular-like geometric shape, the inclined diagonal rod (10), the first auxiliary rods (18) linking together two adjacent mixed connecting nodes (7) of each floating concrete base (1) and the second auxiliary rod (20) joining the mixed connecting node (7) to the connecting element (3).

Inside the mixed connecting node, that is, in the concrete core (8), the active anchors comprising:

- transfer sheets (21) of the four rods (10, 18, 20) which penetrate the mixed connecting node (7), wherein two of them, the inclined diagonal rod (10) and the second auxiliary bar (20) are joined together by welding at the point of intersection of the axes of all the rods (10, 18, 20),
- transfer and connecting sheets (22) joining the first auxiliary rods together, Additionally, the prestressing system (9) is also located inside the mixed connecting node (7), Once the preceding system has been placed, either on the prefabrication bench, or at the port if the mixed connecting node (7) is constructed therein, the node will then be concreted, preceded in the latter case by the concreting of a connection area between the mixed connecting node (7) and the floating concrete base (1), a connection area left as a control element with assembly and execution tolerances.

The prestressing system (9) arranged inside the mixed connecting node (7) that penetrates the floating concrete base (1) is then prestressed, followed by the injection of the sheaths, and lastly the placing and welding of the metal coating (12) of the mixed connecting node (7) which encloses the concrete core (8).

In a second preferred embodiment of the mixed connecting node (27), shown in FIGS. 11 and 12, the mixed connecting node (27) has a metal coating (23) with a tubular-like geometrical shape arranged around a concrete core (24), wherein the metal coating (23) is a steel pipe section open at its upper end, to enable the concreting and the placing of the other elements described in the first embodiment of the mixed node (7).

The mixed connecting core (27) receives, via the metal coating (23) with a tubular-like geometrical shape, the inclined diagonal rod (10), the first auxiliary rods (18) linking together the two adjacent mixed connecting nodes (27) of each floating concrete base (1) and the second auxiliary rod (20) which connects the mixed connecting node (27) to the connecting element (3).

Inside the mixed connecting node (27), that is, in the concrete core (24) the transfer sheets (21) are situated, as well as the transfer and connection sheets (22), the prestressing system (9) and the passive anchors as described above.

The gravity-based foundation system for offshore wind turbine installation further comprises a control system which in turn comprises a sensing subsystem (30), an operational control subsystem (31) and a decision-making subsystem (32) during the transport, anchoring, service and refloating stages, wherein the operative control subsystem enables the coordination between the sensing subsystems and decision-making support subsystem.

The sensing subsystem (30) comprises filling level sensors (33) for the filling of the first group of cells whose function is to measure their ballasting level during the towing, anchoring and refloating stages. They are preferably situated on the lower slab.

The sensing subsystem (30) further comprises inertial acceleration sensors (34) preferably placed on the upper slab of the caisson, in the mixed connection nodes joining and in the connection between the connecting element of the wind turbine and the metal structure. Their function is to measure the accelerations to avoid exceeding the possible thresholds set by the turbine manufacturer during the towing and anchoring stages.

The sensing subsystem (30) further comprises Doppler acoustic sensors (35) for measuring currents in the vicinity of the structure and the distance to the seabed. Its function is to monitor the hydrodynamics surrounding the structure and to control the position of each caisson relative to the seabed in the anchoring stage and to support the erosion evolution characterization during the service stage. They are located at the point where the lower slab and the perimeter wall meet.

The sensing subsystem (30) further comprises a gyro (36) to monitor the roll and pitch of each of the floating concrete bases (1, 4), which are preferably arranged in the centre of each floating concrete base. Its function is to control the verticality of the system during the towing and anchoring stages.

The sensing subsystem (30) further comprises relative and absolute positioning sensors (37) to locate the system during transport and for its dynamic positioning during the anchoring stage. They are arranged on top of the metal structure.

The sensing subsystem (30) further comprises pressure sensors (38) for the estimation of the actions resulting from the interaction between the flow of the sea and the structure during the service stage. They are preferably arranged embedded inside the perimeter walls of floating concrete bases.

The sensing subsystem (30) further comprises deformation sensors (39) that enable the estimation of the number and magnitude of stress load cycles of the system due to its interaction with the ocean flow and/or cyclic stresses transmitted by the wind turbine. They are preferably arranged at the nodes of the metal structure and at the transition point between the metal structure and the floating concrete bases.

The decision-making support subsystem (32) comprises a logical device (40) which is a first-level instrumental alarm to generate warnings to prevent exceeding the thresholds registered by the sensing subsystem, and a second-level prediction device (41) based on a climate prediction system (42) and on the instrumental historical records obtained by the different sensors (33, 34, 35, 36, 37, 38, 39), performing a real-time control (43) by the operational control subsystem (31) and may be displayed on a display device (44); an operational control subsystem (31) acting on the control actuators (45) that perform the opening and/or closing of the valves (46) for water filling and emptying and on a system of anchors and winches (47), to fix the position of the foundation system, generating response scenarios for the foundation system in the short and long term.

The invention claimed is:

1. A gravity-based foundation system for offshore wind turbine installation that comprises:

three floating concrete bases built with self-floating concrete caissons, equipped with valves for filling them with water and emptying the water out enabling their ballasting and anchoring at their final location, a metal structure which connects the three floating concrete bases by means of a connecting element to a wind turbine tower of a wind turbine, and wherein the connecting element which connects the three floating concrete bases to the wind turbine tower is a metal element on which a docking area, a maintenance platform and access stairs are installed;

wherein each of the three floating concrete bases comprises a lower slab which is in contact with the terrain once the system has been submerged, an upper slab, a perimeter wall and interior walls or partitions that define a first group of interconnected cells.

2. The system of claim 1 wherein the metal structure is tripod shaped.

3. The system of claim 1 wherein the metal structure is lattice shaped.

4. The system of claim 1, wherein the attachment of the metal structure to the three floating concrete bases is performed by means of mixed connecting nodes, one for each one of the three floating concrete bases, each of which comprises a concrete core and a prestressing system integrated therein.

5. The system of claim 4 wherein the metal structure comprises three inclined diagonal rods whose ends which connect to each one of the mixed connecting nodes are conical frustum-shaped.

6. The system of claim 5 wherein each one of the mixed connecting nodes further comprises a sheet metal coating externally coating the concrete core.

7. The system of claim 6 wherein each one of the mixed connecting nodes receives, via the metal coating the inclined diagonal rod, some first auxiliary rods joining together two adjacent mixed connecting nodes of each one of the three floating concrete bases and a second auxiliary rod joining each mixed connecting node to the connecting element.

8. The system of claim 7 wherein the metal coating of each one of the mixed connecting nodes has a polyhedral shape with an upper prismatic-trapezoidal-shaped area wherein one of their sides, the one that receives an inclined diagonal rod, is in turn inclined and perpendicular to the inclined diagonal rod, and a lower irregular prismatic-hexagonal-shaped area, wherein two of its vertical sides, which receive some first auxiliary rods linking together two adjacent mixed connecting nodes of each one of the three floating concrete bases, are perpendicular to said first auxiliary rods, wherein the sides, at which the inclined diagonal rod and the first auxiliary bars join, are made of sheet steel.

9. The system of claim 8 wherein the lower irregular prismatic-hexagonal-shaped area of each one of the mixed connecting nodes comprises a vertical side which is situated between the two vertical sides receiving the first auxiliary rods, wherein said vertical side receives the second auxiliary rod which joins each one of the mixed connecting nodes to the connecting element.

10. The system of claim 7 wherein the metal coating of each one of the mixed connecting nodes has a tubular shape and the concrete core is situated in its interior.

11. The system of claim 7 wherein each one of the mixed connecting nodes further comprises active anchors for transmitting forces, while the each one of the three floating concrete bases comprises passive anchors situated therein, either directly on an upper closing slab or on rigidity partitions arranged under each one of the mixed connecting nodes.

12. The system of claim 11 wherein active anchors are placed in the concrete core, comprising:

transfer sheets of the strengths of the four rods which penetrate each one of the mixed connecting nodes, wherein two of them, the inclined diagonal rod and the second auxiliary bar are joined together by welding at the point of intersection of the axes of all the rods, transfer and connecting sheets of the strengths of the first auxiliary rods joining the first auxiliary rods together, and additionally, the prestressing system is also located inside each one of the mixed connecting nodes.

13. The system of claim 1 wherein each one of the three floating concrete bases comprises a group of cells not involved in buoyancy for access from the upper slab to the contact surface between the lower slab and the terrain.

14. The system of claim 1 further comprising a control system which in turn comprises a sensing subsystem, an operational control subsystem and decision-making subsystem wherein the operational control subsystem enables the coordination between the sensing subsystems and the decision-making support subsystem.

15. The system of claim 14 wherein the sensing subsystem comprises at least one of the following:

a filling level sensor for the filling of the first group of interconnected cells to measure their ballasting level, inertial acceleration sensors, doppler acoustic sensors for measuring currents in the vicinity of the system and the distance to the seabed, a gyro for monitoring the roll and pitch of each one of the three floating concrete bases, relative and absolute positioning sensors, pressure sensors for the estimation of actions resulting from the interaction between the ocean flow and the system, deformation sensors for the evaluation of the number and magnitude of stress load cycles of the system through its interaction with the ocean flow and/or cyclic stresses transmitted by the wind turbine.

16. The system of claim 15 wherein the decision-making support subsystem comprises a logical device which is a first-level instrumental alarm to generate warnings to prevent exceeding the thresholds registered by the sensing subsystem, and a second-level prediction device based on a climate prediction system and on the instrumental historical records obtained by different sensors, performing a real-time control by the operational control subsystem and may be displayed on a display device; an operational control subsystem acting on the control actuators that perform the opening and/or closing of the valves for water filling and emptying and on a system of anchors and winches, to fix the position of the foundation system.

17. Method for the installation of an offshore wind turbine foundation system comprising, wherein the system comprises:

three floating concrete bases built with self-floating concrete caissons, equipped with valves for filling them with water and emptying the water out enabling their ballasting and anchoring at their final location, a metal structure which connects the three floating concrete bases by means of a connecting element to the wind turbine tower, and a metal element which connects the floating concrete bases to the wind turbine, metal element on which a docking area is installed, a maintenance platform and access stairs; and wherein each of the three floating concrete bases comprises a lower slab which is in contact with the terrain once the system has been submerged, an upper slab, a perimeter wall and interior walls or partitions that define a first group of interconnected cells; and wherein the method comprises the following stages:

a first transport stage wherein the foundation system is towed from a collecting and/or assembly dock to the final location by using tug boats where the three floating concrete bases are anchored, a second anchoring stage wherein the foundation system is anchored until making contact with the seabed modifying the overall buoyancy by the controlled ballasting of some groups of cells in the three floating concrete bases with the operation of valves located in said bases, and a third refloating stage in the event of dismantling or repositioning of the foundation system by evacuating the water ballast from the previously ballasted cell groups to achieve positive buoyancy of the foundation system.

18. The method of claim 17 wherein before the first transport stage there are a series of foundation system manufacturing stages comprising:

a stage for the manufacturing of the three floating concrete bases at a dock of a port using a floating dock in which a steel tubular projection is left embedded to serve as the connection between the metal structure and the concrete bases, a stage for the manufacturing of the metal structure on land, a stage for the manufacturing of a connecting element that is the base of the wind turbine, a stage of joining together the metal structure and the three floating concrete bases and of welding the connecting element to the metal structure, and a stage for mounting the wind turbine onto the connector element.

* * * * *